US011300905B1

(12) United States Patent
Tomita

(10) Patent No.: US 11,300,905 B1
(45) Date of Patent: Apr. 12, 2022

(54) FIXING DEVICE AND IMAGE FORMING APPARATUS

(71) Applicant: FUJIFILM Business Innovation Corp., Tokyo (JP)

(72) Inventor: Yuhei Tomita, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/325,507

(22) Filed: May 20, 2021

(30) Foreign Application Priority Data

Dec. 4, 2020 (JP) ..... JP2020-202109

(51) Int. Cl.
*G03G 15/20* (2006.01)

(52) U.S. Cl.
CPC ..... *G03G 15/205* (2013.01); *G03G 15/2064* (2013.01)

(58) Field of Classification Search
CPC ..... G03G 15/205; G03G 15/2064
See application file for complete search history.

(56) References Cited

U.S. PATENT DOCUMENTS

2017/0068193 A1* 3/2017 Murakami ..... G03G 15/2042

FOREIGN PATENT DOCUMENTS

| | | | | | |
|---|---|---|---|---|---|
| CN | 1837986 | A | * | 9/2006 | ..... G03G 15/2025 |
| JP | 2002318500 | A | * | 10/2002 | ..... G03G 15/2025 |
| JP | 2005043532 | A | * | 2/2005 | ..... G03G 15/2025 |
| JP | 2020-067466 | A | | 4/2020 | |
| JP | 2020067466 | A | * | 4/2020 | |
| KR | 20060042931 | A | * | 5/2006 | ..... B41J 29/26 |

* cited by examiner

*Primary Examiner* — Sevan A Aydin
(74) *Attorney, Agent, or Firm* — Sughrue Mion, PLLC

(57) ABSTRACT

A fixing device includes: a heating unit configured to come into contact with a medium to heat the medium; and a contacting unit configured to not come into contact with the medium and to come into contact with the heating unit, in which a surface temperature of the contacting unit is made higher than a surface temperature of the heating unit to move deposits from the contacting unit to the heating unit.

20 Claims, 8 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2020-202109 filed Dec. 4, 2020.

BACKGROUND

(i) Technical Field

The present disclosure relates to a fixing device and an image forming apparatus.

(ii) Related Art

In an image forming apparatus such as a copying machine, a printer, or a FAX, regarding a technology for adjusting a state of a surface by bringing a member into contact with a surface of a heating unit of a fixing device, a technology disclosed in JP-A-2020-67466 (paragraph [0040] and FIG. 3) has been known.

JP-A-2020-67466 discloses a technology in which a refresh member 104 is in contact with and be separated from a surface of a fixing roller 51, the refresh member 104 is pressed against the fixing roller 51 at a frequency determined according to the type of recording material, and the fixing roller 51 is rotated so that the surface of the fixing roller 51 is rubbed with the refresh member 104 to alleviate the situation where the surface of the roller 51 is locally roughened, and thus, gloss streaks (image defects, poor fixing) are reduced.

SUMMARY

Aspects of non-limiting embodiments of the present disclosure relate to preventing an increase in the number of parts as compared to a case where a dedicated member configured to clean a contacting unit that comes into contact with a heating unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including: a heating unit configured to come into contact with a medium to heat the medium; and a contacting unit configured to not come into contact with the medium and to come into contact with the heating unit, in which a surface temperature of the contacting unit is made higher than a surface temperature of the heating unit to move deposits from the contacting unit to the heating unit.

BRIEF DESCRIPTION OF THE DRAWINGS

Exemplary embodiment(s) of the present disclosure will be described in detail based on the following figures, wherein.

DETAILED DESCRIPTION

Figure 1:
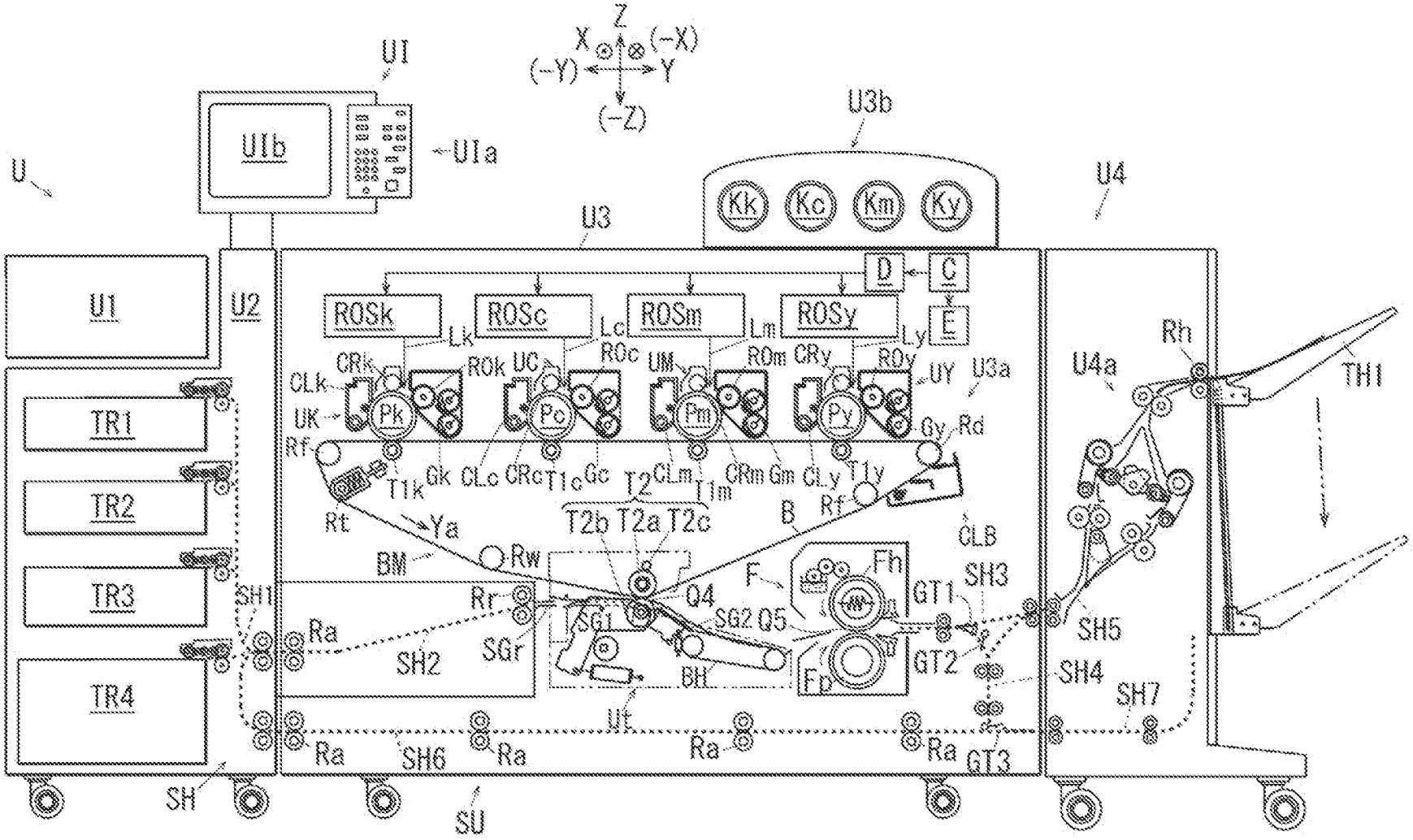
FIG. 1 is an overall view illustrating an image forming apparatus of a first exemplary embodiment.

Hereinafter, specific examples of an exemplary embodiment (hereinafter, referred to as exemplary embodiments) of the present disclosure will be described with reference to the accompanying drawings, but the present disclosure is not limited to the exemplary embodiments.

In order to facilitate the understanding of the following description, in the drawings, the front-back direction is the X-axis direction, the left-right direction is the Y-axis direction, and the up-down direction is the Z-axis direction, and the directions or the sides indicated by the arrows X, −X, Y, −Y, Z, and −Z are front, rear, right, left, upward, and downward, or the front side, the rear side, the right side, the left side, the upper side, and the lower side, respectively.

Further, in the drawings, the symbol "○" having "•" therein represents an arrow from the back surface of a paper toward the front surface, and the symbol "○" having "x" therein represents an arrow from the front surface of a paper toward the back surface.

In the description with reference the following drawings, the illustrations other than members necessary for the explanation are omitted as appropriate for the sake of easy understanding.

First Exemplary Embodiment

Figure 2:
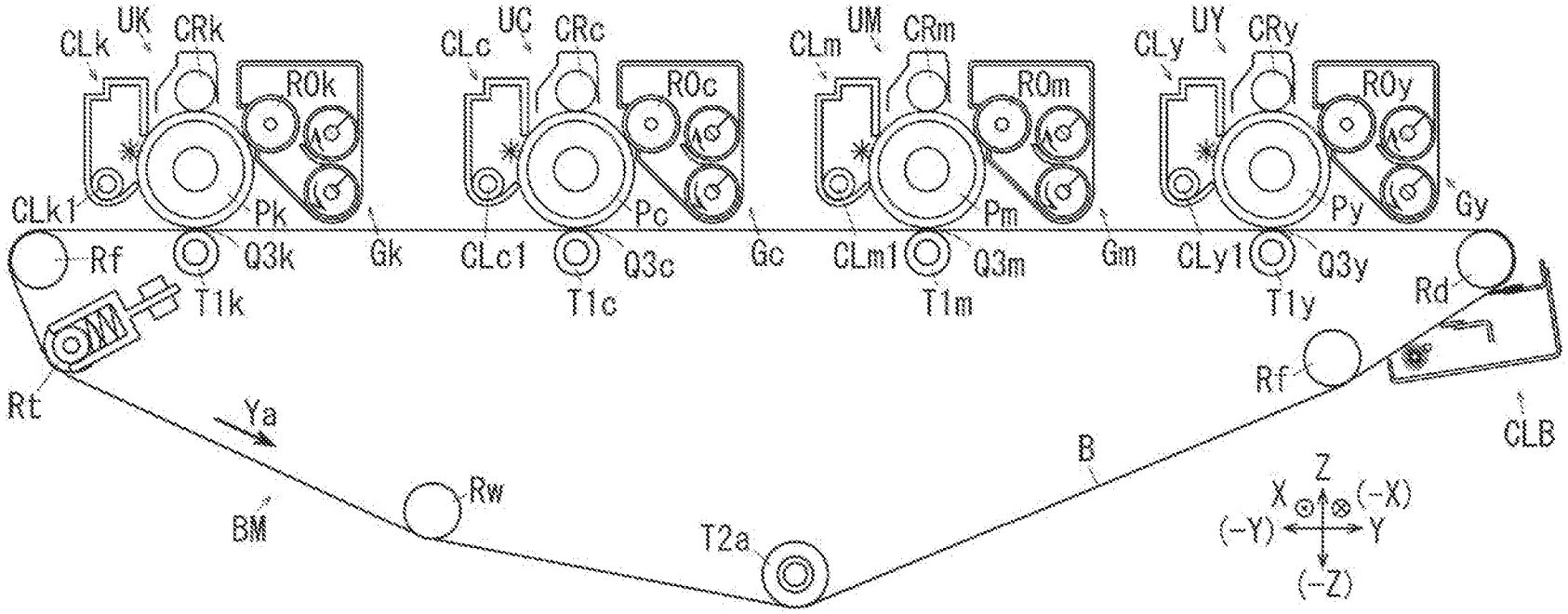
FIG. 2 is an enlarged view illustrating a visible image forming device of the first exemplary embodiment.

FIG. 1 is an overall view illustrating an image forming apparatus of a first exemplary embodiment;

FIG. 2 is an enlarged view illustrating a visible image forming device of the first exemplary embodiment.

In FIG. 1, a copying machine U as an example of an image forming apparatus includes a user interface UI as an example of an operation unit, a scanner unit U1 as an example of an image reading device, a feeder unit U2 as an example of a medium supply device, an image forming unit U3 as an example of an image recording device, and a medium processing device U4.

Description of User Interface UI

The user interface UI includes an input button UIa used for starting copying, setting the number of copies, or the like. Further, the user interface UI includes a display unit UIb on which the contents input by the input button UIa or the state of the copying machine U is displayed.

Description of Feeder Unit U2

In FIG. 1, the feeder unit U2 includes plural sheet feeding trays TR1, TR2, TR3, and TR4 as examples of a medium accommodating container. Further, the feeder unit U2 has, for example, a medium supply path SH1 through which a recording sheet S as an image recording medium accommodated in each of the sheet feeding trays TR1 to TR4 is taken out, and is transported to the image forming unit U3.

Description of Image Forming Unit U3 and Medium Processing Device U4

In FIG. 1, the image forming unit U3 includes an image recording unit U3*a* that records an image based on an original image read by the scanner unit U1 on the recording sheet S transported from the feeder unit U2.

In FIGS. 1 and 2, a driving circuit D of a latent image forming device of the image forming unit U3 outputs a driving signal at a predetermined timing based on the image information input from the scanner unit U1 to latent image forming devices ROSy, ROSm, ROSc, and ROSk of each color Y to K. Photoconductor drums Py, Pm, Pc, and Pk as examples of an image carrier are disposed below each of the latent image forming devices ROSy to ROSk as examples of a writing unit.

The surfaces of the rotating photoconductor drums Py, Pm, Pc, and Pk are uniformly charged by charging rollers CRy, CRm, CRc, and CRk as examples of a charging unit, respectively. An electrostatic latent image is formed on the surfaces of the photoconductor drums Py to Pk with the surface charged by laser beams Ly, Lm, Lc, and Lk as examples of latent image writing light output by the latent image forming devices ROSy, ROSm, ROSc, and ROSk. The electrostatic latent images on the surfaces of the photoconductor drums Py, Pm, Pc, and Pk are developed into toner images as examples of visible images of yellow (Y), magenta (M), cyan (C), and black (K) by developing devices Gy, Gm, Gc, and Gk as examples of a developing unit.

In the developing devices Gy to Gk, the developer consumed for the development is replenished from toner cartridges Ky, Km, Kc, and Kk as examples of a developer accommodating unit. The toner cartridges Ky, Km, Kc, and Kk are detachably mounted to a developer replenishing device U3*b*.

The toner images on the surfaces of the photoconductor drums Py, Pm, Pc, and Pk are sequentially overlapped and transferred on an intermediate transfer belt B as an example of an intermediate transfer unit in primary transfer regions Q3*y*, Q3*m*, Q3*c*, and Q3*k* by primary transfer rollers T1*y*, T1*m*, T1*c*, and T1*k* as examples of a transfer unit and as examples of a primary transfer device, and thus, a color toner image as an example of a multicolor visible image is formed on the intermediate transfer belt B. The color toner image formed on the intermediate transfer belt B is transported to a secondary transfer region Q4.

In a case where there is only K color image information, the photoconductor drum Pk and the developing device Gk of K color are used, and only the K color toner image is formed.

Residues such as a residual developer and paper dust adhering to the surface of the photoconductor drum Py, Pm, Pc, and Pk after the primary transfer are removed by drum cleaners CLy, CLm, CLc, and CLk as examples of a cleaner of an image carrier.

In the first exemplary embodiment, the photoconductor drum Pk, the charging roller CRk, and the drum cleaner CLk are integrated as a K color photoconductor unit Uk as an example of an image carrier unit. Then, similarly, for other colors Y, M, and C, photoconductor units UY, UM, and UC include the photoconductor drums Py, Pm, and Pc, the charging rollers CRy, CRm, and CRc, and the drum cleaners CLy, CLm, and CLc.

Further, a K color visible image forming device UK+Gk includes the K color photoconductor unit UK and the developing device Gk having a developing roller R0*k* as an example of a developer carrying unit. Similarly, Y, M, and C color visible image forming devices UY+Gy, UM+Gm, and UC+Gc include the Y, M, and C color photoconductor units UY, UM, and UC, and the developing devices Gy, Gm, and Gc having developing rollers R0*y*, R0*m*, and R0*c*, respectively.

A belt module BM as an example of the intermediate transfer unit is disposed below the photoconductor drums Py to Pk. The belt module BM includes the intermediate transfer belt B as an example of the image carrier, a driving roller Rd as an example of a driving unit of the intermediate transfer unit, a tension roller Rt as an example of a tension applying unit, a walking roller Rw as an example of a meandering preventing unit, plural idler rollers Rf as an example of a follower unit, a backup roller T2*a* as an example of a facing unit, and the primary transfer rollers T1*y*, T1*m*, T1*c*, and T1*k*. The intermediate transfer belt B is supported to be rotatable and movable in the direction of the arrow Ya.

A secondary transfer unit Ut is disposed below the backup roller T2*a*. The secondary transfer unit Ut includes a secondary transfer roller T2*b* as an example of a secondary transfer unit. The secondary transfer region Q4 is formed by a region where the secondary transfer roller T2*b* contacts the intermediate transfer belt B. Further, the backup roller T2*a* as an example of the facing unit faces the secondary transfer roller T2*b* across the intermediate transfer belt B. The backup roller T2*a* is in contact with a contact roller T2*c* as an example of a power feeding unit. A secondary transfer voltage having the same polarity as the charging polarity of the toner is applied to the contact roller T2*c*.

A secondary transfer device T2 as an example of the transfer unit includes the backup roller T2*a*, the secondary transfer roller T2*b*, and the contact roller T2*c*.

A medium transport path SH2 is disposed below the belt module BM. The recording sheet S fed from the medium supply path SH1 of the feeder unit U2 is transported to a registration roller Rr as an example of a transport timing adjusting unit by a transport roller Ra as an example of a medium transport unit. The registration roller Rr transports the recording sheet S to the downstream side at the timing when the toner image formed on the intermediate transfer belt B is transported to the secondary transfer region Q4. The recording sheet S delivered by the registration roller Rr is guided by a sheet guide SGr on the registration side and a sheet guide SG1 before transfer, and is transported to the secondary transfer region Q4.

The toner image on the intermediate transfer belt B is transferred to the recording sheet S by the secondary transfer device T2 when passing through the secondary transfer region Q4. In a case of the color toner image, the toner images overlapped and primarily transferred on the surface of the intermediate transfer belt B are collectively secondarily transferred to the recording sheet S.

Transfer devices (transfer units) T1*y* to T1*k*+T2+B of the first exemplary embodiment include the primary transfer rollers T1*y* to T1*k*, the secondary transfer device T2, and the intermediate transfer belt B.

The intermediate transfer belt B after the secondary transfer is cleaned by a belt cleaner CLB as an example of a cleaner of the intermediate transfer unit disposed downstream of the secondary transfer region Q4. The belt cleaner CLB removes residues such as the remained developer that is not transferred or paper dust from the intermediate transfer belt B in the secondary transfer region Q4.

The recording sheet S on which the toner image is transferred is guided by a sheet guide SG2 after the transfer, and sent to a belt transport device BH as an example of the medium transport unit. The belt transport device BH transports the recording sheet S to a fixing device F.

The fixing device F includes a heating roller Fh as an example of a heating unit and a pressurizing roller Fp as an example of a pressurizing unit. The recording sheet S is transported to a fixing region Q5, which is a region where the heating roller Fh and the pressurizing roller Fp contacts each other. The toner image of the recording sheet S is heated and pressurized by the fixing device F to be fixed when passing through the fixing region Q5.

The image recording unit U3*a* as an example of an image forming unit of the first exemplary embodiment includes the visible image forming devices UY+Gy to UK+Gk, the transfer devices T1*y* to T1*k*+T2+B, and the fixing device F.

A switching gate GT1 as an example of a switching unit is provided downstream of the fixing device F. The switching gate GT1 selectively switches the recording sheet S that has passed through the fixing region Q5 to either a discharge path SH3 on the medium processing device U4 side or a reverse path SH4. The recording sheet S transported to the discharge path SH3 is transported to a sheet transport path SH5 of the medium processing device U4. A curl correcting member U4*a* as an example of a warp correcting unit is disposed in the sheet transport path SH5. The curl correcting member U4*a* corrects the warp of the carried-in recording sheet S, which is so-called curl. The recording sheet S with curl corrected is discharged to a discharge tray TH1 as an example of a medium discharge unit by a discharge roller Rh as an example of a medium discharge member with the image fixing surface of the sheet facing upward.

The recording sheet S transported to the reverse path SH4 side of the image forming unit U3 by the switching gate GT1 passes through a second gate GT2 as an example of a switching member and is transported to the reverse path SH4 of the image forming unit U3.

At this time, when it is discharged with the image fixing surface of the recording sheet S facing downward, the transport direction of the recording sheet S is reversed after the rear end portion of the recording sheet S in the transport direction passes through the second gate GT2. Here, the second gate GT2 of the first exemplary embodiment includes a thin-film elastic member. Therefore, the second gate GT2 once passes the recording sheet S transported to the reverse path SH4 as it is, and when the passed recording sheet S is reversed while being reversed, so-called switched-back, guides the recording sheet S to the discharge path SH3 side and the transport path SH5 side. Then, the switched-back recording sheet S passes the curl correcting member U4*a*, and is discharged to the discharge tray TH1 with the image fixing surface facing downward.

A circulation path SH6 is connected to the reverse path SH4 of the image forming unit U3, and a third gate GT3 as an example of the switching unit is disposed at the connection portion. Further, the downstream end of the reverse path SH4 is connected to a reverse path SH7 of the medium processing device U4.

The recording sheet S passed through the switching gate GT1 and transported to the reverse path SH4 is transported to the reverse path SH7 side of the medium processing device U4 by the third gate GT3. The third gate GT3 of the first exemplary embodiment includes a thin-film elastic member, similarly to the second gate GT2. Therefore, the third gate GT3 once passes the recording sheet S transported to the reverse path SH4, and when the passed recording sheet S is switched-back, guides the recording sheet S to the circulation path SH6 side.

The recording sheet S transported to the circulation path SH6 passes the medium transport path SH2 and is fed to the secondary transfer region Q4 again, and printing on the second surface is performed.

A sheet transport path SH includes the components represented by the reference numerals SH1 to SH7. A sheet transport device SU of the first exemplary embodiment includes the components represented by the reference numerals SH, Ra, Rr, Rh, SGr, SG1, SG2, BH, and GT1 to GT3.

Description of Fixing Device

Figure 3:
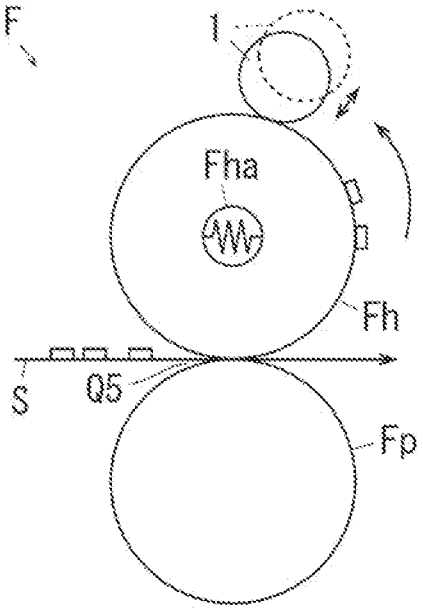
FIG. 3 is an enlarged view illustrating a fixing device of the first exemplary embodiment.

FIG. 3 is an enlarged view illustrating a fixing device of the first exemplary embodiment.

In FIG. 3, in the fixing device F of the first exemplary embodiment, a conditioning roller 1 as an example of a contacting unit faces the heating roller Fh. The conditioning roller 1 is disposed downstream of the fixing region Q5 in the rotation direction of the heating roller Fh. Therefore, the conditioning roller 1 is disposed in a non-contact state with respect to the recording sheet S or the pressurizing roller Fp.

The conditioning roller 1 of the first exemplary embodiment is configured to be movable between a contact position (see the solid line in FIG. 3) contacting the heating roller Fh and a separation position (see the broken line in FIG. 3) separated from the heating roller Fh. The configuration in which the conditioning roller 1 is brought into contact with and separated from the heating roller Fh is known in the related art (see, for example, JP-A-2020-67466), and various configurations may be adopted, and thus, detailed description will be omitted.

The conditioning roller 1 of the first exemplary embodiment is in contact with the heating roller Fh, and is rotated by following the heating roller Fh when the heating roller Fh rotates, so that the unevenness of the surface of the heating roller Fh in a rough state is alleviated. Further, the conditioning roller 1 of the first exemplary embodiment is in contact with the entire region of the heating roller Fh in the width direction and a large amount of heat is transferred from the high temperature region, so that the conditioning roller 1 also has a function of alleviating a temperature difference between the low temperature region which is in contact with the recording sheet S and the high temperature region which is not in contact with the recording sheet S in the heating roller Fh.

Description of Controller of First Exemplary Embodiment

Figure 4:
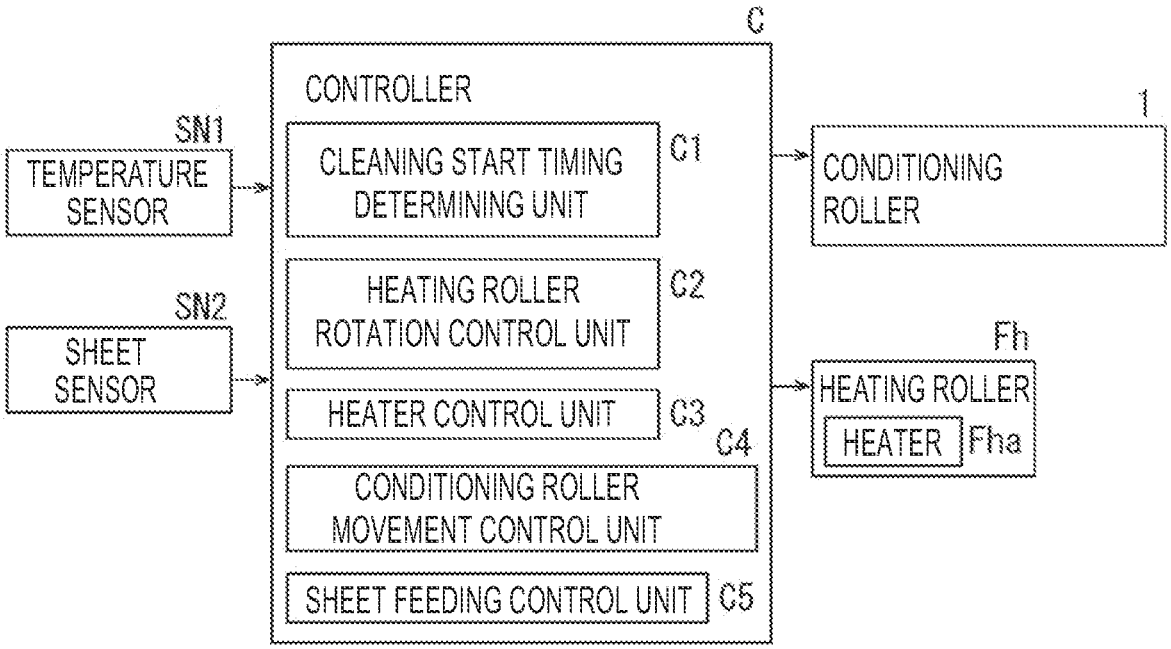
FIG. 4 illustrates a controller of the first exemplary embodiment.

FIG. 4 illustrates a controller of the first exemplary embodiment.

In FIG. 4, a controller C as an example of a control unit of the copying machine U has an input/output interface I/O that inputs/outputs a signal to/from the outside. Further, the controller C has a read only memory (ROM) in which a program, information, and the like for performing necessary processes are stored. Further, the controller C has a random access memory (RAM) that temporarily stores necessary data. Further, the controller C has a central processing unit (CPU) that performs a process according to the program stored in the ROM or the like. Therefore, the controller C of the first exemplary embodiment includes a small information processing device, a so-called microcomputer. Therefore, the controller C may implement various functions by executing the program stored in the ROM or the like.

The controller C of the first exemplary embodiment is input a signal from a signal output element and controls by outputting a signal to a controlled element.

Description of Signal Output Element

A signal from a signal output element such as a temperature sensor SN1 or a sheet sensor SN2 is input to the controller C.

The temperature sensor SN1 faces the conditioning roller 1 and detects a surface temperature T1 of the conditioning roller 1.

The sheet sensor SN2 is disposed downstream of the fixing region Q5 and detects the recording sheet S.

Description of Controlled Elements

The controller C outputs a signal to controlled elements such as the conditioning roller 1, the heating roller Fh, a heater Fha, or a power supply circuit E.

Function of Controller C

The controller C of the first exemplary embodiment includes following functional units (functional module and program module) C1 to C5.

A cleaning start timing determining unit C1 determines whether it is the timing to clean the conditioning roller 1. In the cleaning start timing determining unit C1 of the first exemplary embodiment, an end timing of a job, which is a series of printing operations, is set in advance as an example of the timing for cleaning the conditioning roller 1. The timing for cleaning is not limited to the end timing of a job, and may be an optional timing such as when the cumulative number of printings reaches a predetermined number, when the power in turned on, once a week, or the like, depending on settings of a user, specification, or the like.

A heating roller rotation control unit C2 as an example of a heating unit rotation control unit controls the rotation of the heating roller Fh. The heating roller rotation control unit C2 of the first exemplary embodiment rotates the heating roller Fh during the job, and rotates the heating roller Fh during the cleaning operation of the conditioning roller 1.

A heater control unit C3 as an example of a heat source control unit controls the heater Fha as an example of the heat source built in the heating roller Fh. The heater control unit C3 of the first exemplary embodiment controls the ON/OFF of the heater Fha such that the temperature of the fixing region Q5 becomes a predetermined fixing temperature during the job and the cleaning operation of the conditioning roller 1. In the first exemplary embodiment, when the cleaning operation of the conditioning roller 1 is started, it is controlled to a first control temperature, which is high temperature, in order to quickly raise the temperature of the conditioning roller 1, and when the temperature rise of the conditioning roller 1 is completed, it is controlled to a second control temperature, which is lower than the first control temperature. The second control temperature may be a temperature at which the developer transmitted from the conditioning roller 1 to the heating roller Fh is transmitted and fixed from the heating roller Fh to the recording sheet S. The control temperature is not limited to the case of having two stages, and may have one stage or three or more stages.

A conditioning roller movement control unit C4 moves the conditioning roller 1 between the contact position and the separation position. The conditioning roller movement control unit C4 of the first exemplary embodiment moves the conditioning roller 1 to the contact position for a predetermined period when it is necessary to adjust the rough state of the surface of the heating roller Fh or the unevenness of the temperature during the job, for example, when a predetermined number of the recording sheets S has passed continuously, or the recording sheets S having a small size are continuously used, and moves the conditioning roller 1 to the separation position for other periods. The present disclosure is not limited to this, and it may be possible to have a configuration in which the conditioning roller 1 is continuously held at the contact position during the job.

Then, when the cleaning operation of the conditioning roller 1 is started, the conditioning roller 1 is moved to the contact position (when the conditioning roller 1 is already moved to the contact position, the conditioning roller 1 is held at the contact position). Subsequently, when the temperature of the conditioning roller 1 reaches a predetermined set temperature Ta, the conditioning roller 1 is moved to the separation position. Subsequently, when the surface temperature of the conditioning roller 1 becomes higher than the surface temperature of the heating roller Fh, the conditioning roller 1 is moved to the contact position. Then, when the cleaning operation is ended, the conditioning roller 1 is moved to the separation position.

A sheet feeding control unit C5 feeds the recording sheet S at a predetermined interval during the job, and when the cleaning operation of the conditioning roller 1 is started, and when the surface temperature T1 of the conditioning roller 1 reaches the set temperature Ta, feeds the recording sheet S for cooling, and when the surface temperature of the conditioning roller 1 becomes higher than the surface temperature of the heating roller Fh, feeds the recording sheet S for cleaning. In the first exemplary embodiment, both the recording sheet S for cooling and the recording sheet S for cleaning uses the recording sheet S accommodated in the sheet feeding trays TR1 to TR4, not a dedicated recording sheet, but it is also possible to use a dedicated recording sheet. For example, it is possible to use a thick paper having a large heat capacity as the recording sheet for cooling, or to use a special sheet having a surface on which a process is performed so that a developer easily adheres as the recording sheet for cleaning. It is possible to set the dedicated recording sheet in the sheet feeding trays TR1 to TR4, and, in an image forming apparatus having a manual feed tray, to feed using the manual tray.

Description of Flowchart of First Exemplary Embodiment

Subsequently, the flow of the control in the copying machine U of the first exemplary embodiment will be described using a so-called flowchart.

Figure 5:
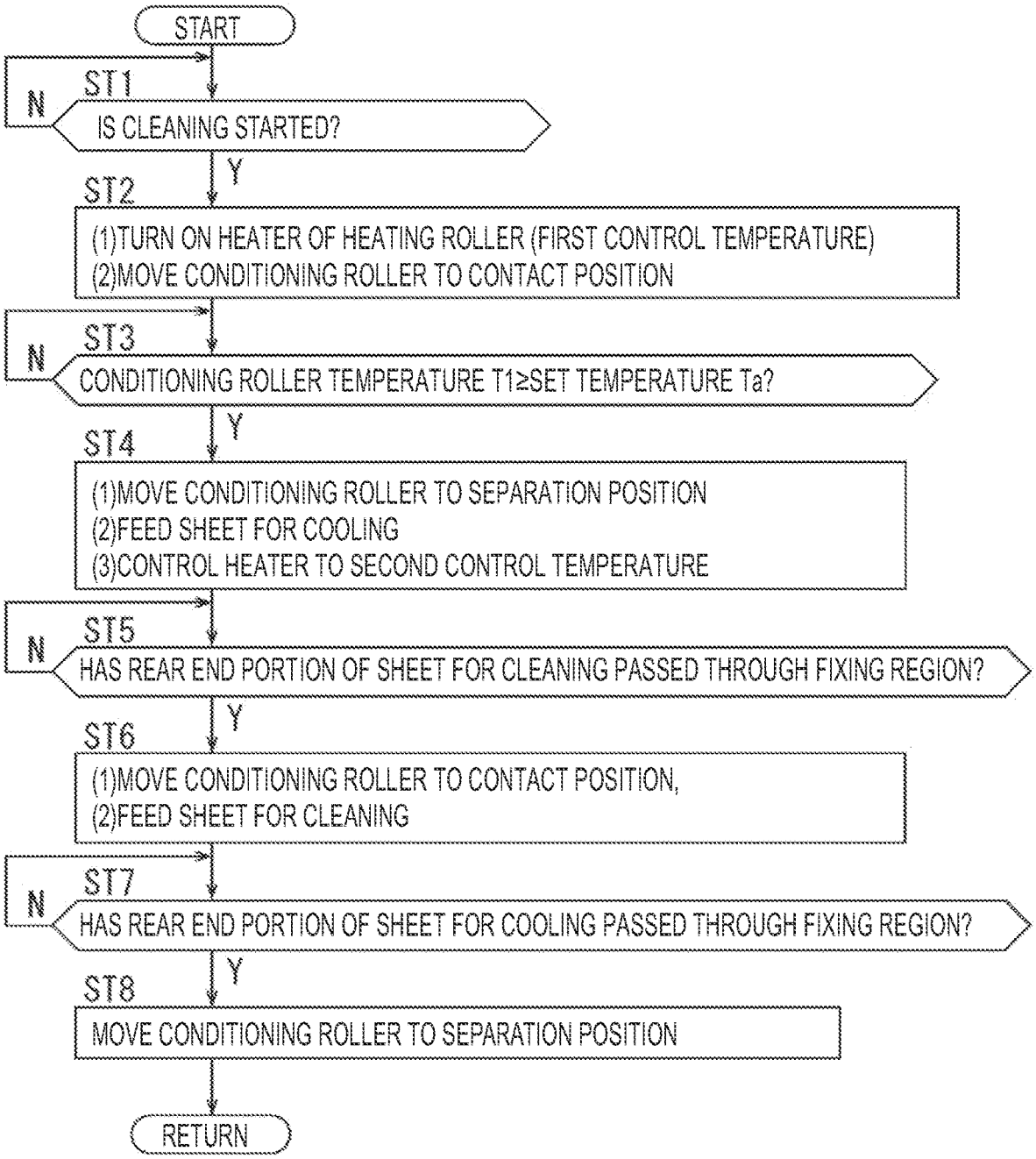
FIG. 5 is a flowchart of a cleaning processing of the first exemplary embodiment.

FIG. 5 is a flowchart of a cleaning process of the first exemplary embodiment.

The process in each step ST in the flowchart in FIG. 5 is performed according to the program stored in the controller C. Further, the process is performed in parallel with various other processes of the copying machine U.

The flowchart illustrated in FIG. 5 is started by turning on the copying machine U.

In step ST1 in FIG. 5, it is determined whether the cleaning operation of the conditioning roller 1 is started. When it is "Yes" (Y), the process proceeds to step ST2, and when it is "No" (N), step ST1 is repeated.

In step ST2, following processes (1) and (2) are performed, and the process proceeds to step ST3. (1) Turn on the heater of the heating roller Fh, and control to the first control temperature. (2) Move the conditioning roller 1 to the contact position.

In step ST3, it is determined whether the surface temperature T1 of the conditioning roller 1 reaches the set temperature Ta. When it is "Yes" (Y), the process proceeds to step ST4, and when it is "No" (N), step ST3 is repeated.

In step ST4, following processes (1) to (3) are performed, and the process proceeds to step ST5. (1) Move the conditioning roller 1 to the separation position. (2) Feed the recording sheet S for cooling. (3) Control the control temperature of the heating roller Fh to the second control temperature.

In step ST5, it is determined whether the rear end portion of the recording sheet S for cooling has passed through the fixing region Q5. When it is "Yes" (Y), the process proceeds to step ST6, and when it is "No" (N), step ST5 is repeated.

In step ST6, following processes (1) and (2) are performed, and the process proceeds to step ST7. (1) Move the conditioning roller 1 to the contact position. (2) Feed the recording sheet S for cleaning.

In step ST7, it is determined whether the rear end portion of the recording sheet S for cleaning has passed through the fixing region Q5. When it is "Yes" (Y), the process proceeds to step ST8, and when it is "No" (N), step ST7 is repeated.

In step ST8, the heater of the heating roller Fh is in a standby state (fixing temperature is maintained at a predetermined standby temperature), the conditioning roller 1 is moved to the separation position, and the cleaning operation of the conditioning roller 1 is ended. Then, the process returns to step ST1.

Effects of First Exemplary Embodiment

Figure 6:
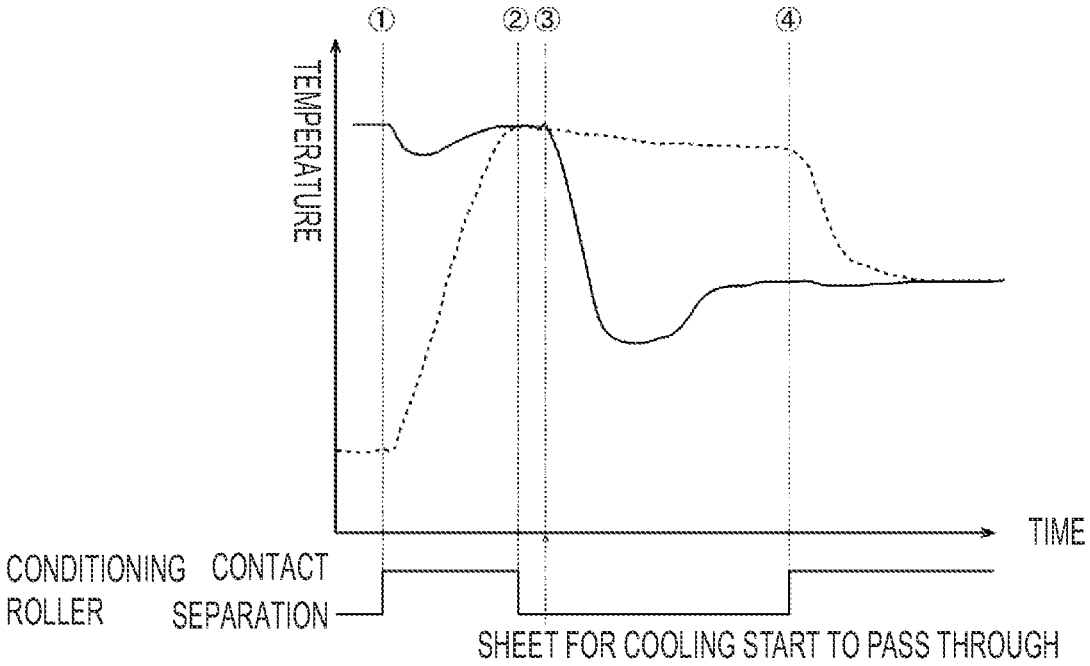
FIG. 6 illustrates temperature changes of a heating roller and a conditioning roller during a cleaning operation of the first exemplary embodiment.

FIG. 6 illustrates temperature changes of a heating roller and a conditioning roller during a cleaning operation of the first exemplary embodiment.

In the copying machine U of the first exemplary embodiment including the above configuration, when the cleaning operation of the conditioning roller 1 is started, the conditioning roller 1 is brought into contact with the heating roller Fh. Therefore, heat is transferred from the heating roller Fh to the conditioning roller 1, and the temperature of the conditioning roller 1 is raised as illustrated in FIG. 6. When the temperature of the conditioning roller 1 is raised to the set temperature Ta, the conditioning roller 1 is separated from the heating roller Fh. Therefore, the conditioning roller 1 is in a naturally cooled state. Meanwhile, the recording sheet S for cooling is brought into contact with the heating roller Fh from which the conditioning roller 1 is separated. Therefore, the heat is absorbed from the heating roller Fh to the recording sheet S. Therefore, the surface temperature of the heating roller Fh is rapidly decreased as compared to the surface temperature of the conditioning roller 1 that is naturally cooled. Therefore, the surface temperature of the conditioning roller 1 becomes higher than the surface temperature of the heating roller Fh. In this state, the conditioning roller 1 is brought into contact with the heating roller Fh.

The developer, paper dust, or the like adheres to the surface of the heating roller Fh from the recording sheet S that passes through the fixing region Q5 during the job. Dirt such as the developer also adheres to and accumulates on the conditioning roller 1. The higher the temperature of the developer, the easier the developer to be melted (loose), and as the temperature becomes constant, the developer tends to harden. Therefore, among the heating roller Fh and the conditioning roller 1, the developer tends to move from a high-temperature member to a low-temperature member, and to adhere.

As the configuration disclosed in JP-A-2020-67466, in the configuration in which a member that cleans the refresh roller is not provided, the developer is accumulated on the refresh roller. When the developer is accumulated and becomes a lump of the developer, the lump of the developer may fall off from the refresh roller, adhere to the heating roller, be moved to the recording sheet being printed, and cause image quality defects such as black spots. However, when a dedicated cleaning member that cleans the refresh roller is provided, there is a problem that the number of parts increases, and thus, the manufacturing cost increases, and the size of the fixing device becomes large.

In contrast, in the first exemplary embodiment, in the cleaning operation of the conditioning roller 1, a state where the surface temperature of the conditioning roller 1 is higher than the surface temperature of the heating roller Fh is created. Therefore, the developer is easily moved from the high-temperature conditioning roller 1 toward the low-temperature heating roller Fh. Then, the developer adhering to the heating roller Fh is adhering to the recording sheet S for cleaning, is collected, and is discharged to the outside of the fixing device F. Therefore, the cleaning of the deposits adhering to the conditioning roller 1 is performed. Therefore, in the first exemplary embodiment, it is possible to clean the conditioning roller 1 without adding the dedicated configuration for cleaning the conditioning roller 1. That is, it is possible to clean the conditioning roller 1 and prevent the occurrence of the image defects while preventing the increase in the number of parts.

Particularly, in the first exemplary embodiment, the deposits from the conditioning roller 1 is eventually transmitted to the recording sheet S, and discharged to the outside of the apparatus. When the deposits are collected into the apparatus, a maintenance job is required to regularly dispose of the deposits after the collection to the outside the apparatus. However, in the first exemplary embodiment, the regular maintenance job is unnecessary.

Further, in the first exemplary embodiment, the heating roller Fh is cooled by contacting the recording sheet S. Therefore, it is not necessary to add a dedicated device for cooling, for example, a cooling fan, and thus, the increase in the number of parts is prevented. Particularly, by using the recording sheet S, a special cooling configuration is not required, and it is possible to simply cool the heating roller Fh.

Further, in the first exemplary embodiment, the temperature of the conditioning roller 1 is raised by contacting the heating roller Fh. Therefore, it is not necessary to add a dedicated configuration configured to raise the temperature of the conditioning roller 1, for example, a dedicated heater for the conditioning roller 1 or the like, and thus, the increase in the number of parts is prevented.

Further, in the first exemplary embodiment, after the temperature of the conditioning roller 1 is raised, a temperature difference from the heating roller Fh occurs only by keeping being separated from the heating roller Fh. Therefore, it is not necessary to add some special configuration to the conditioning roller 1, and it is possible to create the temperature difference between the conditioning roller 1 and the heating roller Fh with a simple configuration.

Second Exemplary Embodiment

Figure 7:
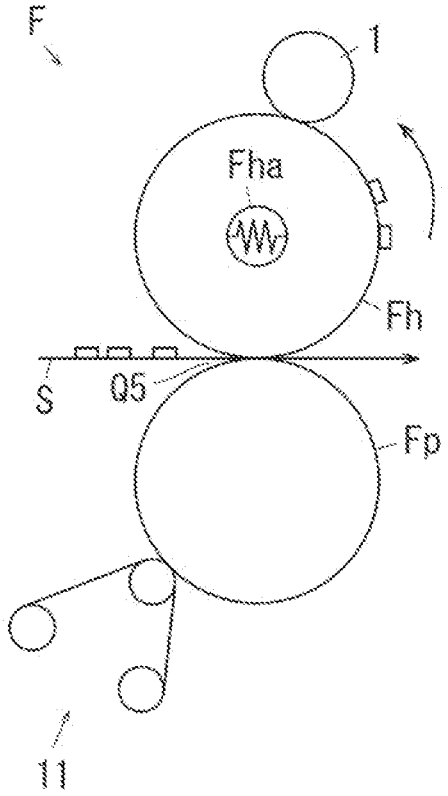
FIG. 7 illustrates a fixing device of a second exemplary embodiment, which corresponds to FIG. 3 of the first exemplary embodiment.

FIG. 7 illustrates a fixing device of a second exemplary embodiment, which corresponds to FIG. 3 of the first exemplary embodiment.

Subsequently, the second exemplary embodiment of the present disclosure will be described, but in the description of the second exemplary embodiment, elements corresponding to the elements of the first exemplary embodiment are designated by the same reference numerals, and detailed description thereof will be omitted.

The second exemplary embodiment is different from the first exemplary embodiment in the following aspects, but is configured in the same manner as the above first exemplary embodiment in other aspects.

In the fixing device F of the second exemplary embodiment, the pressurizing roller Fp as an example of the pressurizing unit is configured to be in contact with and separated from the heating roller Fh. Further, a cleaning web 11 as an example of the cleaner is disposed for the pressurizing roller Fp. The cleaning web 11 is brought into contact with the surface of the pressurizing roller Fp to clean the deposits on the surface of the pressurizing roller Fp.

A contact and separation mechanism of the pressurizing roller Fp is known in the related art (see, for example, JP-A-2020-67466), and various configurations known from the related art may be adopted, and thus, detailed description will be omitted. Further, the cleaning web 11 itself is also commercially available, detailed description thereof will be omitted.

Description of Controller of Second Exemplary Embodiment

Figure 8:
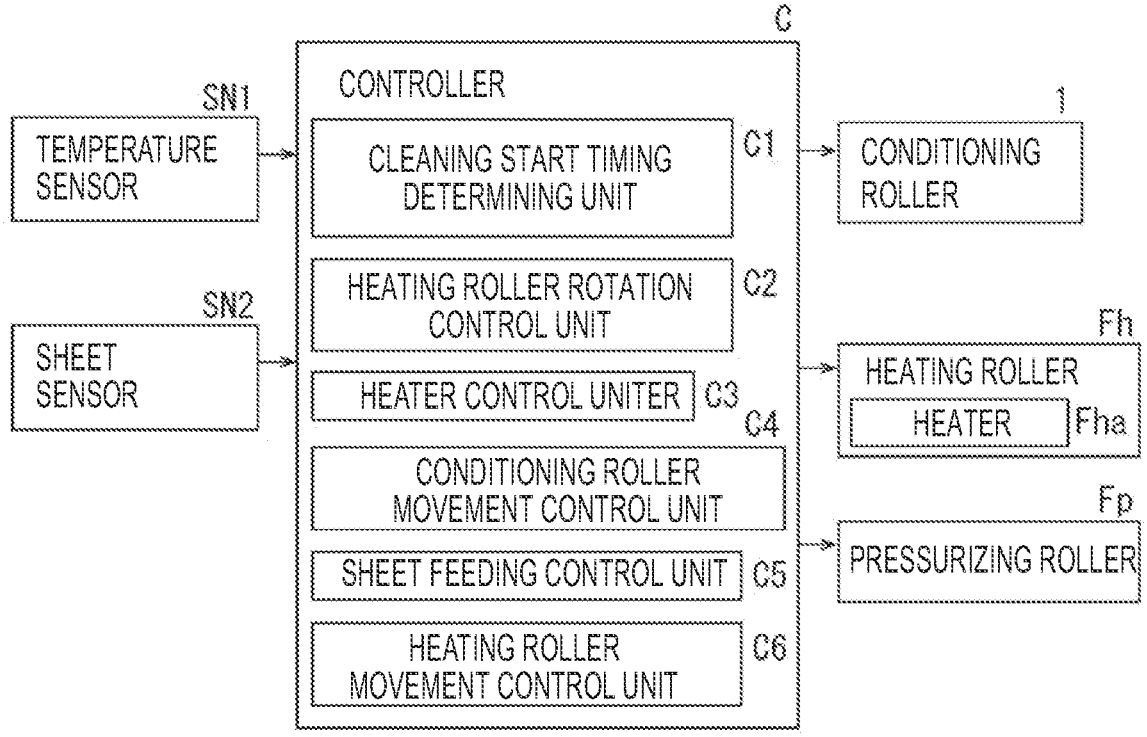
FIG. 8 illustrates a controller of the second exemplary embodiment, which corresponds to FIG. 4 of the first exemplary embodiment.

FIG. 8 illustrates a controller of the second exemplary embodiment, which corresponds to FIG. 4 of the first exemplary embodiment.

In FIG. 8, the controller C of the second exemplary embodiment is different from the controlled element and the functional unit of the first exemplary embodiment in the following aspects.

Description of Controlled Element

The controller C of the second exemplary embodiment also outputs a signal to the contact and separation mechanism of the pressurizing roller Fp as an example of the controlled element, in addition to each controlled element of the first exemplary embodiment.

Function of Controller C

The controller C of the second exemplary embodiment has a pressurizing roller movement control unit C6 in addition to each of the units C1 to C5 of the first exemplary embodiment.

The pressurizing roller movement control unit C6 moves the pressurizing roller Fp between an approaching position approaching the heating roller Fh and a separation position separated from the heating roller Fh. The pressurizing roller movement control unit C6 of the second exemplary embodiment maintains the state where the pressurizing roller Fp is in contact with the heating roller Fh, during the job. Then, when the job is ended, the pressurizing roller Fp is moved to the separation position.

After the job is ended, the heating roller Fh becomes a standby state, and in the standby state, the heater is controlled to be turned on/off to maintain the standby temperature, the pressurizing roller Fp and the conditioning roller 1 are separated from each other, and the motor of the fixing device F is stopped.

Then, when the cleaning operation of the conditioning roller 1 is started, the pressurizing roller Fp is moved to the separation position until the temperature of the conditioning roller 1 is raised to the set temperature Ta. Then, when the conditioning roller 1 reaches the set temperature Ta, the pressurizing roller Fp is moved to the approaching position.

Description of Flowchart of Second Exemplary Embodiment

Figure 9:
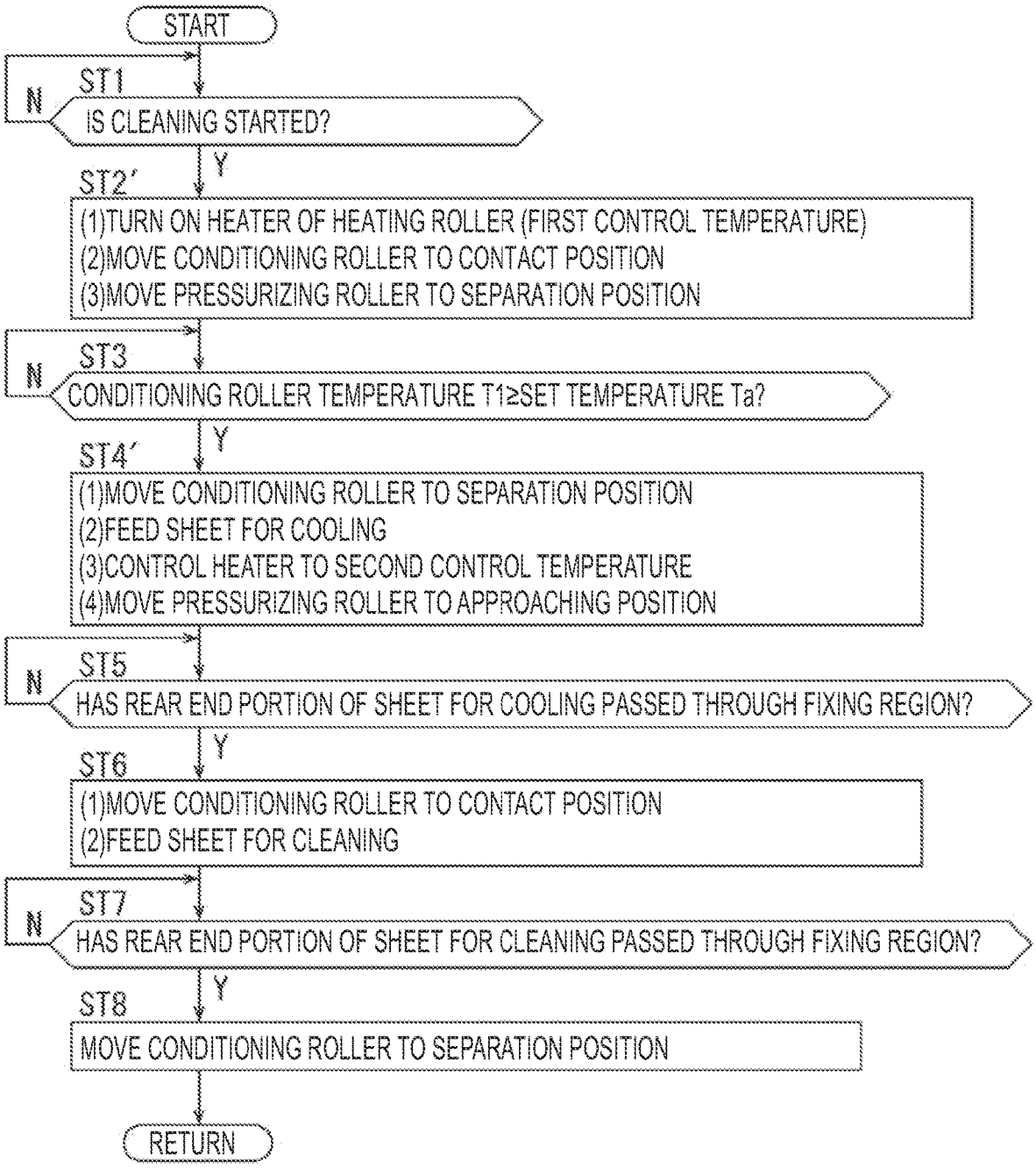
FIG. 9 is a flowchart of a cleaning processing of the second exemplary embodiment, which corresponds to FIG. 5 of the first exemplary embodiment.

FIG. 9 is a flowchart of a cleaning process of the second exemplary embodiment, which corresponds to FIG. 5 of the first exemplary embodiment.

In FIG. 9, in the cleaning process of the second exemplary embodiment, following steps ST2' and ST4' are performed instead of steps ST2 and ST4 of the cleaning process of the first exemplary embodiment.

In step ST2', following processes (1) to (3) are performed, and the process proceeds to step ST3. (1) Turn on the heater of the heating roller Fh, and control to the first control temperature. (2) Move the conditioning roller 1 to the contact position. (3) Move the pressurizing roller Fp to the separation position.

In step ST4', following processes (1) to (4) are performed, and the process proceeds to step ST5. (1) Move the conditioning roller 1 to the separation position. (2) Feed the recording sheet S for cooling. (3) Control the control temperature of the heating roller Fh to the second control temperature. (4) Move the pressurizing roller Fp to the approaching position.

Effects of Second Exemplary Embodiment

Figure 10:
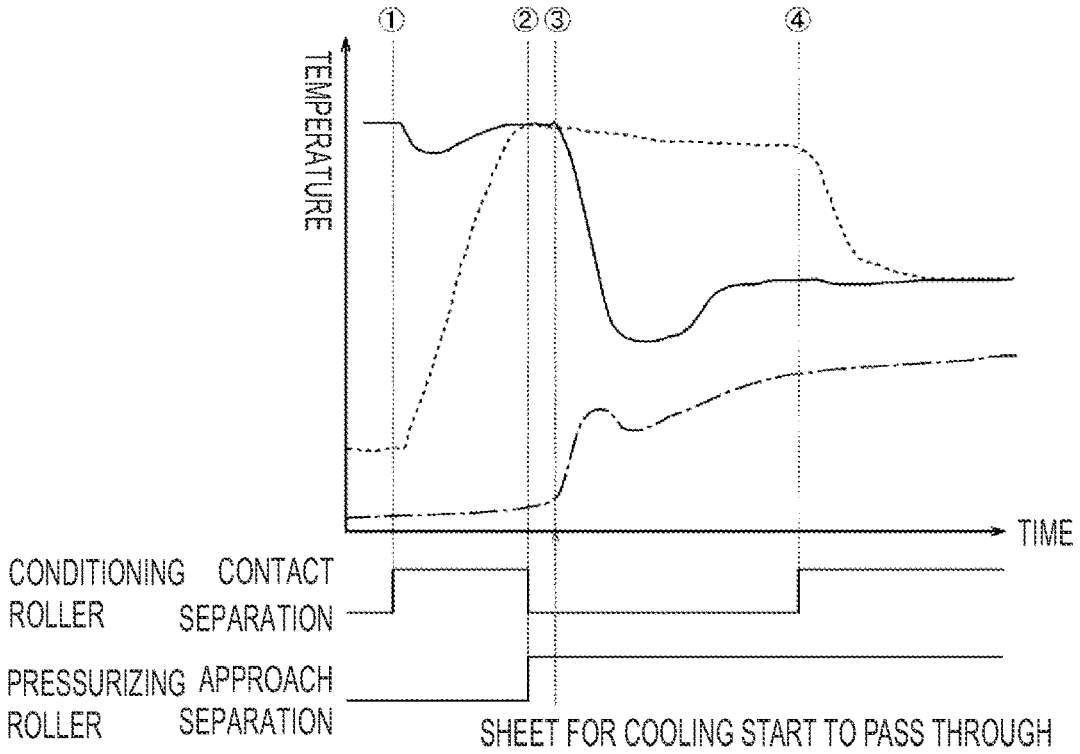
FIG. 10 illustrates temperature changes of a heating roller, a conditioning roller, and a pressurizing roller during a cleaning operation of the second exemplary embodiment, which corresponds to FIG. 6 of the first exemplary embodiment.

FIG. 10 illustrates temperature changes of a heating roller, a conditioning roller, and a pressurizing roller during a cleaning operation of the second exemplary embodiment, which corresponds to FIG. 6 of the first exemplary embodiment.

In the copying machine U of the second exemplary embodiment including the above configuration, when the cleaning operation of the conditioning roller 1 is started, the pressurizing roller Fp is separated from the heating roller Fh. Therefore, as illustrated by the alternate long and short dash line in FIG. 10, the pressurizing roller Fp is naturally cooled, and a temperature difference from the heating roller Fh occurs. Then, when the pressurizing roller Fp is brought into contact with the heating roller Fh, the recording sheet S for cooling passes therebetween, and the heat is absorbed from the pressurizing roller Fp to the recording sheet S. Therefore, the surface temperature of the pressurizing roller Fp is also rapidly decreased. Therefore, the surface temperature is in the state of the conditioning roller 1>the heating roller Fh>the pressurizing roller Fp. Therefore, for example, the developer adhering to the surface of the conditioning roller 1 is transmitted in order of the heating roller Fh and the pressurizing roller Fp. Then, the deposits adhering to the surface of the pressurizing roller Fp are removed and cleaned by the cleaning web 11.

Therefore, in the second exemplary embodiment, it is possible to also clean the conditioning roller 1 using the cleaning web 11, which is the cleaner of the pressurizing roller Fp. Therefore, it is not necessary to newly provide the dedicated cleaner for the conditioning roller 1, and thus, the increase in the number of parts is prevented.

Further, in the second exemplary embodiment, it is not necessary to feed the recording sheet S for cleaning, and thus, the amount of the medium used is reduced as compared to the case of the first exemplary embodiment.

In FIG. 10, when the cleaning of the conditioning roller 1 is performed during the job or immediately after the end of the job, the pressurizing roller Fp is in a high temperature state at the stage of starting of the cleaning. Therefore, it is possible to deal with the matter by separating the pressurizing roller Fp from the heating roller Fh, and delaying the timing of contacting the pressurizing roller Fp again or the timing of feeding the recording sheet S for cooling until the temperature of the heating roller Fp is sufficiently decreased.

Modification of Second Exemplary Embodiment

Figure 11:
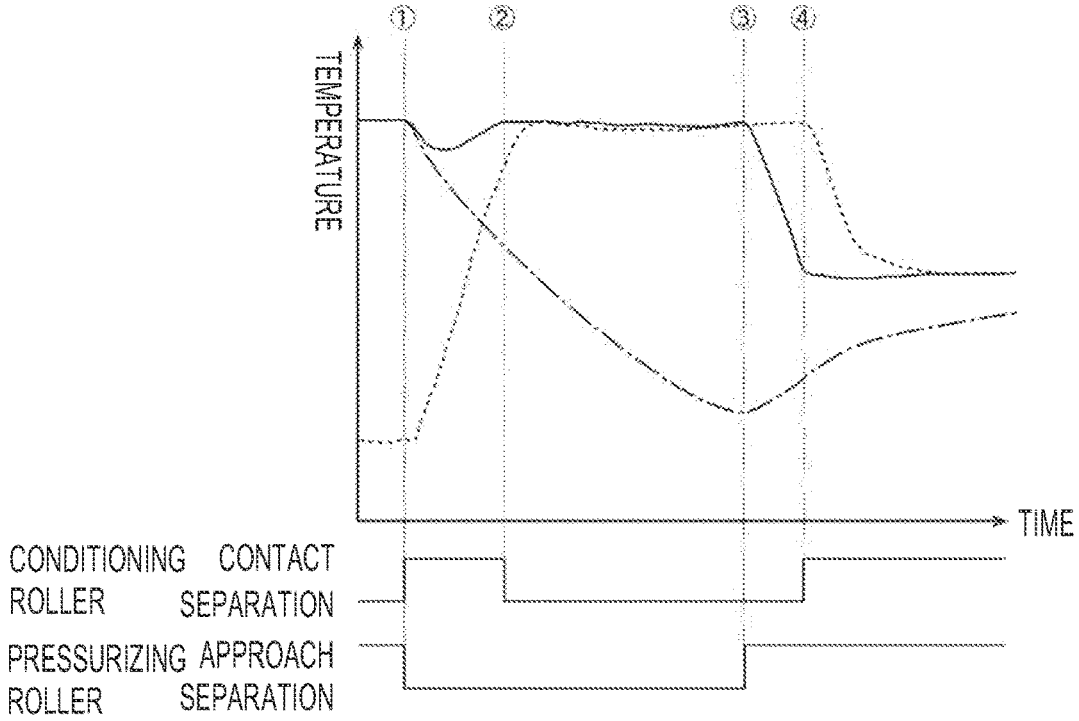
FIG. 11 illustrates temperature changes of a heating roller, a conditioning roller, and a pressurizing roller during a cleaning operation of a modification of the second exemplary embodiment, which corresponds to FIG. 6 of the first exemplary embodiment.

FIG. 11 illustrates temperature changes of a heating roller, a conditioning roller, and a pressurizing roller during a cleaning operation of a modification of the second exemplary embodiment, which corresponds to FIG. 6 of the first exemplary embodiment.

In FIG. 11, it is possible to configure such that, in a state where the pressurizing roller Fp is separated from the heating roller Fh, after a sufficient time has elapsed, or after the surface temperature of the pressurizing roller Fp is sufficiently decreased by air-cooling with a fan or the like, the pressurizing roller Fp comes into contact with the heating roller Fh. In this case, without feeding the recording sheet S for cooling, it is possible to decrease the surface temperature of the heating roller Fh by contacting the pressurizing roller Fp of which the temperature is sufficiently lowered.

In this case, it is not necessary to feed the recording sheet S for cooling, and thus, the amount of the medium used is reduced.

MODIFIED EXAMPLE

In the above, although the exemplary embodiments of the present disclosure have been described in detail, the present disclosure is not limited to the above exemplary embodiments, and various modifications may be made within the scope of the gist of the present disclosure disclosed in the claims. Modified examples (H01) to (H08) of the present disclosure are illustrated below.

(H01) In the above exemplary embodiments, the copying machine U is illustrated as an example of the image forming apparatus. The present disclosure is not limited thereto, but may be applied to a FAX, or a multifunction device having plural functions such as a FAX, a printer, and a copying machine. Further, the present disclosure is not limited to the image forming apparatus for multicolor development, but may be a monochromatic, a so-called monochrome image forming apparatus.

(H02) In the above exemplary embodiments, the specific number illustrated may be appropriately modified according to modifications in design and specifications. For example, the number of or the intervals between the crests are not limited to the illustrated form, and may be modified according to the purpose.

(H03) In the above exemplary embodiments, the configuration for detecting the surface temperature T1 of the conditioning roller 1 is illustrated, but the present disclosure is not limited thereto. For example, when the time required for the conditioning roller 1 reaches the set temperature Ta is determined in advance by an experiment or the like, it is also possible to determine the timing for separating the conditioning roller 1 based on the elapsed time after the conditioning roller 1 contacts the heating roller Fh.

(H04) In the above exemplary embodiments, the sheet sensor SN2 detects the passage of the recording sheet S for cooling or the passage of the recording sheet S for cleaning, but the present disclosure is not limited thereto. When the time from the start of the sheet feeding to the passage through the fixing region Q5 is known in advance, it is possible to perform each process based on the time until the passage. Further, the case where the rear end portion of the recording sheet S passes through the fixing region Q5 is illustrated, but the present disclosure is not limited thereto. For example, although the recording sheet S is passing through the fixing region Q5, when the target temperature difference is satisfied, it is possible to move the conditioning roller 1.

(H05) In the above exemplary embodiments, the case where the cooling of the heating roller Fh is performed by contacting the recording sheet S or the pressurizing roller Fp, is illustrated. The present disclosure is not limited thereto. It is possible to use a cooling unit such as a cooling fan, or a cooling unit that contacts the heating roller Fh, which is different from the pressurizing roller Fp, and absorbs heat.

(H06) In the above exemplary embodiments, the heating and the temperature rise of the conditioning roller 1 may be performed by contacting the heating roller Fh, but the present disclosure is not limited thereto. For example, it is possible to have a configuration in which a heater is built in the conditioning roller 1 itself to raise the temperature. When a heater is built in, a member is not disposed outside the conditioning roller 1, and thus, it is possible to avoid the increase in the size of the fixing device F. Further, in this case, after the cleaning operation is started, it is not necessary to bring the conditioning roller 1 into contact with the heating roller Fh to heat, and it is possible to heat the conditioning roller 1 by turning on the heater of the conditioning roller 1 while being separated from the heating roller Fh.

(H07) In the above exemplary embodiments, the heating roller Fh and the pressurizing roller Fp are illustrated as the heating unit and the pressurizing unit, but the present disclosure is not limited thereto. Any shape such as a belt shape may be used as well as a roller shape. Further, it is also possible to use the heating roller Fh that has a built-in heater on both the top and bottom, instead of using the pressurizing roller Fp that does not have a built-in heater.

(H08) In the above exemplary embodiments, the configuration in which the conditioning roller 1 is rotated by being followed the heating roller Fh is illustrated, but the present disclosure is not limited thereto. It is also possible that the conditioning roller 1 is not rotatable, or is rotated at a lower speed than the heating roller Fh to rub the surface of the heating roller Fh.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a heating unit configured to come into contact with a medium to heat the medium; and a contacting unit configured to not come into contact with the medium and to come into contact with the heating unit, wherein a surface temperature of the contacting unit is made higher than a surface temperature of the heating unit to move deposits from the contacting unit to the heating unit.

2. The fixing device according to claim 1, wherein the heating unit is configured to move the deposits, which have been moved from the contacting unit, to the medium.

3. The fixing device according to claim 2, wherein the heating unit is cooled such that the surface temperature of the contacting unit becomes higher than the surface temperature of the heating unit.

4. The fixing device according to claim 3, wherein the heating unit is configured to come into contact with the medium to cool the heating unit.

5. The fixing device according to claim 3, further comprising:

a pressurizing unit that faces the heating unit, the pressurizing unit being configured to contact the medium to apply pressure to the medium, wherein the pressurizing unit is brought into contact with the heating unit to cool the heating unit such that the surface temperature of the contacting unit becomes higher than the surface temperature of the heating unit.

6. The fixing device according to claim 2, wherein after the surface temperature of the heating unit is decreased by separating the contacting unit and the heating unit from each other, the contacting unit is brought into contact with the heating unit to increase the surface temperature of the contacting unit to be higher than the surface temperature of the heating unit.

7. The fixing device according to claim 1, further comprising:

a pressurizing unit that faces the heating unit, the pressurizing unit being configured to come into contact with the medium to apply pressure to the medium; and a cleaner configured to not come into contact with the medium and to come into contact with the pressurizing unit so as to clean deposits on a surface of the pressurizing unit, wherein the deposits moved from the contacting unit to the heating unit are moved to the surface of the pressurizing unit and then removed by the cleaner.

8. The fixing device according to claim 7, wherein after the surface temperature of the contacting unit is made higher than the surface temperature of the heating unit, the pressurizing unit is brought into contact with the heating unit.

9. The fixing device according to claim 8, wherein the heating unit is cooled such that the surface temperature of the contacting unit becomes higher than the surface temperature of the heating unit.

10. The fixing device according to claim 9, wherein the heating unit is configured to come into contact with the medium to cool the heating unit.

11. The fixing device according to claim 9, wherein the pressurizing unit is brought into contact with the heating unit to cool the heating unit such that the surface temperature of the contacting unit becomes higher than the surface temperature of the heating unit.

12. The fixing device according to claim 7, wherein the heating unit is cooled such that the surface temperature of the contacting unit becomes higher than the surface temperature of the heating unit.

13. The fixing device according to claim 12, wherein the heating unit is configured to come into contact with the medium to cool the heating unit.

14. The fixing device according to claim 12, wherein the pressurizing unit is brought into contact with the heating unit to cool the heating unit such that the surface temperature of the contacting unit becomes higher than the surface temperature of the heating unit.

15. The fixing device according to claim 1, wherein the heating unit is cooled such that the surface temperature of the contacting unit becomes higher than the surface temperature of the heating unit.

16. The fixing device according to claim 15, wherein the heating unit is configured to come into contact with the medium to cool the heating unit.

17. The fixing device according to claim 15, further comprising:

a pressurizing unit that faces the heating unit, the pressurizing unit being configured to contact the medium to apply pressure to the medium, wherein the pressurizing unit is brought into contact with the heating unit to cool the heating unit such that the surface temperature of the contacting unit becomes higher than the surface temperature of the heating unit.

18. The fixing device according to claim 1, wherein after the surface temperature of the heating unit is decreased by separating the contacting unit and the heating unit from each other, the contacting unit is brought into contact with the heating unit to increase the surface temperature of the contacting unit to be higher than the surface temperature of the heating unit.

19. The fixing device according to claim 18, wherein before the contacting unit and the heating unit are separated from each other, the contacting unit is brought into contact with the heating unit to increase the surface temperature of the contacting unit.

20. An image forming apparatus comprising:

an image carrier;

a transfer unit configured to transfer an image on a surface of the image carrier to a medium; and the fixing device according to claim 1, the fixing device being configured to fix the image transferred to the medium.

* * * * *